United States Patent [19]

Buttery

[11] Patent Number: 5,026,970

[45] Date of Patent: Jun. 25, 1991

[54] COOKING APPLIANCES

[75] Inventor: Michael H. Buttery, Surrey, United Kingdom

[73] Assignee: Emaco Ltd., United Kingdom

[21] Appl. No.: 385,545

[22] Filed: Jul. 27, 1989

[30] Foreign Application Priority Data

Jul. 29, 1988 [GB] United Kingdom ..... 8818104

[51] Int. Cl.[5] ..... H05B 3/72

[52] U.S. Cl. ..... 219/465; 219/543; 219/464

[58] Field of Search ..... 219/457, 465, 464, 543, 219/345

[56] References Cited

U.S. PATENT DOCUMENTS

| | | | |
|---|---|---|---|
| 1,943,144 | 1/1934 | Richardson | 219/458 |
| 2,664,492 | 12/1953 | Fischer | 219/457 |
| 2,859,321 | 11/1958 | Garaway | 219/543 |
| 2,939,807 | 6/1960 | Needham | 219/543 |
| 3,047,702 | 7/1962 | Lefebvre | 219/464 |
| 3,067,315 | 12/1962 | Hurko | 219/543 |
| 3,109,228 | 11/1963 | Dyke | 219/543 |
| 3,612,827 | 10/1971 | Dills | 219/463 |
| 3,679,473 | 7/1972 | Blatchford | 219/543 |
| 3,694,627 | 9/1972 | Blatchford | 219/543 |
| 3,737,624 | 6/1973 | Eilenberger | 219/464 |
| 3,798,759 | 3/1974 | Gerds | 219/464 |
| 3,895,216 | 7/1975 | Hurko | 219/464 |

FOREIGN PATENT DOCUMENTS

| | | | |
|---|---|---|---|
| 1075817 | 2/1960 | Fed. Rep. of Germany | 219/464 |
| 3445454 | 7/1987 | Fed. Rep. of Germany | 219/463 |
| 871371 | 6/1961 | United Kingdom | 219/458 |

*Primary Examiner*—Teresa J. Walberg

*Attorney, Agent, or Firm*—Hill, Van Santen, Steadman & Simpson

[57] ABSTRACT

This invention relates to cooking appliances. More particularly the invention relates to a heater unit for a cooking appliance and comprises a heater unit for a cooking appliance comprising a substrate, a layer consisting of or containing a ceramic material applied to the substrate and an electrically conducting path to the said layer.

5 Claims, 2 Drawing Sheets

COOKING APPLIANCES

This invention relates to cooking appliances and, more particularly, to electric heating units for cooking appliances. For simplicity, throughout this specification, particular reference will be made to a heater unit suitable for a cooking hob but it will be understood that the underlying concept is also applicable to such a unit used to heat an oven or a grill.

In order to satisfy user requirements a heater unit for a cooking appliance should ideally have a life of 2/3000 hours operating under steady or cyclic conditions up to a temperature of 550° C. Ideally also, such a heater unit should possess a low thermal mass to produce an acceptably rapid heating response up to the required cooking temperature.

Traditionally, in Europe, for example, a heater unit for a hob comprises a cast iron substrate having an electrical heater element, usually of spiral configuration, encased in a ceramic material and attached to the underside of the cast iron substrate. On the other hand, a heater unit traditionally used in the United States of America and the United Kingdom comprises a radiant tubular or coiled element on which a cooking utensil is directly supported during cooking.

According to the present invention a heater unit for a cooking appliance comprises a substrate, a layer consisting of or containing a ceramic material applied to the substrate and an electrically conducting path applied to the said layer.

In the first form of heater unit according to this invention, the substrate is cast iron and the working surface, that is, the surface opposite from the electrically conducting path may be protected in the traditional way with a high temperature resistant paint finish.

The invention will now be described by way of example, with reference to the accompanying drawings in which.

Figure 1:
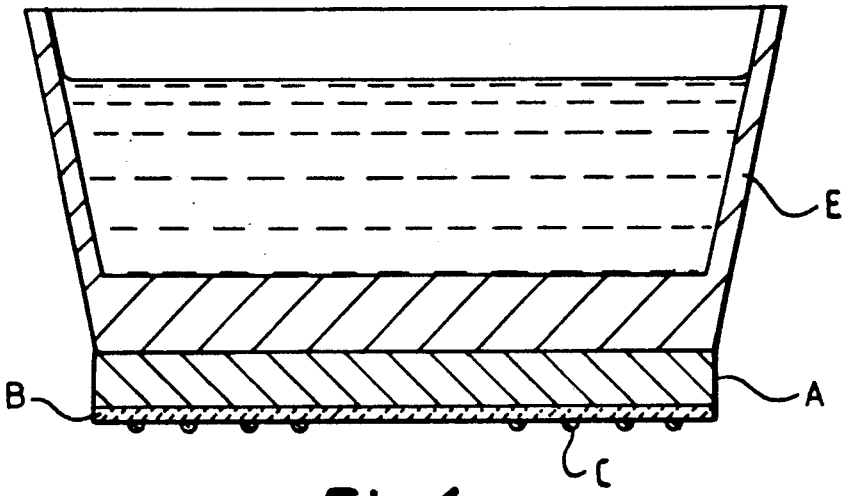
FIG. 1 shows, in section, a first form of heater unit with a cast iron substrate heater support and a ceramic coating on that surface to which a heating element is applied.

The heater unit illustrated in FIG. 1 has a circular cast iron substrate A of thickness 2 mm on to the lower surface of which a ceramic layer B is applied. A spiral or other electrically conductive path C constituting the heating element is applied to the ceramic layer B and suitable conductors and electrical connectors (not shown) are secured to the heating element for connection to a power supply in known manner. A cooking utensil E is shown supported on the heater unit.

Figure 2:
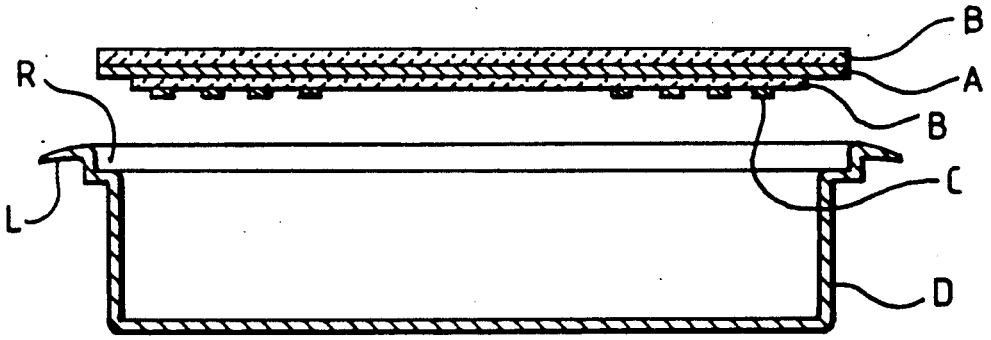
FIG. 2 shows, in section, a second form of heater unit having a sheet metal substrate heater support bearing a ceramic coating on both major surfaces.

The heater unit shown in FIG. 2 in which the same reference numbers are used for the same components as FIG. 1, has a substrate A made from sheet metal of thickness up to 15 mm, for example 5 mm. In this form of heater unit the surface opposite the electrically heating element C also has applied thereto a layer of ceramic material B which constitutes the working surface. Preferably, the two layers of ceramic material in the second form of heater are thermally compatible. Conveniently, the said two layers of ceramic material have the same composition.

The heater unit of FIG. 2 is circular in plan and is mounted in an annular recess R formed in a shallow metal dish D. A radially outwardly extending lip L forms a rim to protect the edge of the unit and, when the heater unit is sealed in the dish D, liquids etc. are prevented from entering into the dish. The lip L also serves as a stop when the unit/dish assembly is mounted in, for example, a cooker top or a ceramic hob plate.

Figure 3:
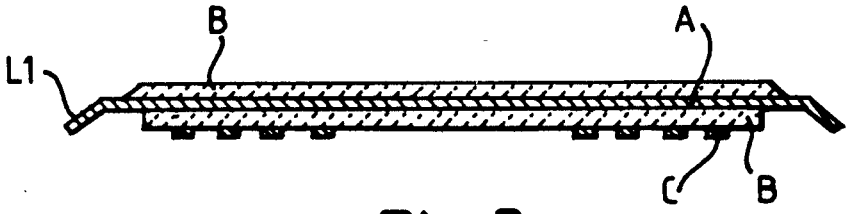
FIG. 3 is a modification of the heater unit shown in FIG. 2.
Figure 4A:
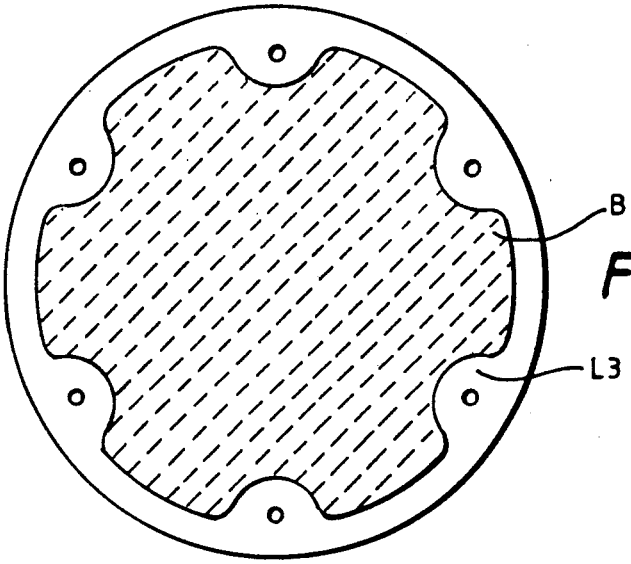
FIGS. 4A, 4B and 4C show, in section modifications of the heater unit of FIG. 1.
Figure 4B:
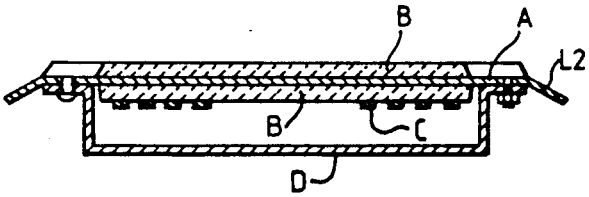

The substrate of the heater unit, when considered in plan, may be made in many different shapes and not simply circular, for example, rectangular, oval, square or any combination thereof. The substrate A may be preformed prior to further processing including the application of subsequent ceramic layer(s) or may form part of a large sheet of substrate material bearing the ceramic layer(s) B and a plurality of conductive paths for a number of heater units. Where a relatively thin sheet metal substrate is used additional stiffness may be required. Such additional stiffness may be achieved by forming a trim ring separately from, or integrally with the substrate material. An integral trim ring is shown at L1 and L2 in FIGS. 3 and 4B respectively. FIG. 4A which is an under plan of the heater unit of FIG. 4B when removed from dish D, also illustrates six inwardly extending semi-circular projections L3 for spot/stud welding, rivetting or otherwise fixing the substrate to a dish.

Figure 4C:
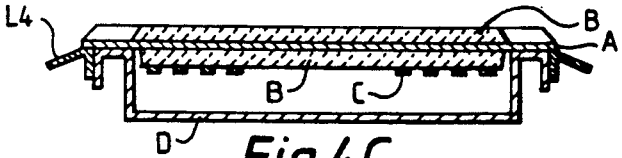

A separate trim L4 is shown in FIG. 4C attached to a downwardly extending flange D3 of a roll or otherwise formed reinforcing peripheral channel section of the dish D.

A variety of different forms of stiffening for the heater plate may be used in order to ensure that the substrate remains flat and maintains good contact with the cooking vessel. These forms (not shown) include, for example, a central recess, or radial or circumferential recesses in the heater surface.

Irrespective of whether the heater plate has an integral trim ring or not, when made from sheet metal it may be attached to the base cover in various ways by, for example:

(a) Rivetting;

(b) Welding;

(c) Studs which may be clipped or screw threaded, and (d) Locking tabs.

Where the substrate is made from cast iron, it may be attached to the heater in a number of ways for example:

(i) by a central stud;

(ii) by machining a peripheral groove therein and clipping the base plate and cast iron plate together with the whole assembly being retained by the separate trim ring;

(iii) a combination of a peripheral groove and slots to form "bayonet" fixing;

(iv) Either separate clips or clips integral with the base cover, and (v) a downwardly extending central spigot may be formed integrally with or welded to the substrate irrespective of material used to the depth of the dish D. The spigot and the dish may then be welded or otherwise attached eg. by using a screw passing through the bottom of the dish and threaded into the spigot. If desired a plurality of spigots may be used.

Figure 5:
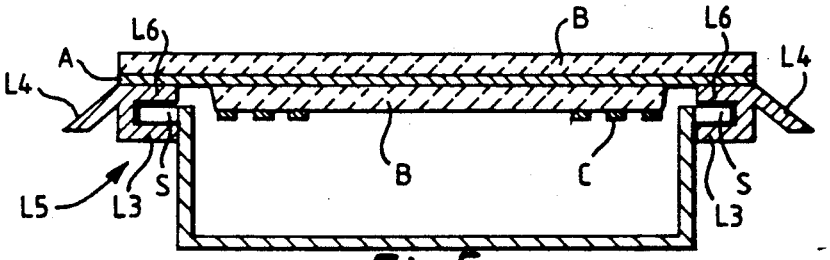
FIG. 5 shows in section a heater unit with a cast iron substrate heater support including a base cover and a twin ring.

These various forms of fixing are illustrated by way of example in FIG. 5 for circular shaped heater units.

In FIG. 5 a trim L4 is shown with an inwardly extending 'U' -sectioned channel having flanges L5 and L6. The heater unit and dish D are fitted together using a bayonet type principle. In more detail, the lower flange L5 consists of a plurality of inwardly extending projections similar to projections L3 in FIG. 4A an correspondingly shaped slots 5 with appropriate clearance and with the same pitch are formed on both the heater unit and flange L6 of the dish D. To assemble the projections are inserted in the slots and the heater unit and the dish are displaced angularly relatively to each other.

In addition to ceramic working surface B being applied to the substrate to support a cooking utensil, a further ceramic or other protective layer, not shown, may be applied to overlay the electrically conductive path C.

The electrically conductive path may be applied using thick film or other known techniques.

I claim:

1. A hob assembly for a cooking appliance, said hob comprising:

a substrate made from a sheet metal having an upper side, an underside and a periphery which is common to the upper side and underside;

a layer comprising ceramic material applied to at least said underside of said substrate;

an electrically conducting path applied to said layer;

a supporting dish having a rim in contact with and supporting said substrate; and the periphery of the substrate constituting a trim which overlays and extends outwardly beyond the rim of the supporting dish, said trim being formed in one piece with said substrate.

2. A hob assembly for a cooking appliance, said hob assembly comprising:

a substrate made from a sheet having an upper side, an underside, a periphery which is common to said upper side and said underside and a groove formed in said periphery;

a layer comprising ceramic material applied to at least said underside of said substrate;

an electrically conducting path applied to said layer;

a supporting dish having a rim in contact with and supporting said substrate; and an annular trim surrounding said periphery, said trim having a channel cross-section comprising an upper, radially inwardly extending flange which is engaged with said groove, and a lower, radially inwardly extending flange which engages a radially outwardly extending portion of said supporting dish, said lower radially inwardly extending flange and said outwardly extending portion having co-operating mutually engaged radially extending projection and recess configurations for enabling said dish to be disengaged from said substrate and said trim by relative rotation of said dish with respect to said substrate and said trim.

3. A hob assembly according to claim 2, further comprising ceramic: material which overlies at least said electrically conducting path.

4. A hob assembly according to claim 2, further comprising:

a layer of ceramic material applied to said upper said of said substrate.

5. A hob assembly according to claim 2, wherein said electrically conductive path is a film which has been applied by a thick film technique.

* * * * *